US011046087B2

(12) United States Patent
Singh et al.

(10) Patent No.: US 11,046,087 B2
(45) Date of Patent: Jun. 29, 2021

(54) VACUUM OPERATED PUMPS

(71) Applicant: Hewlett-Packard Development Company, L.P., Spring, TX (US)

(72) Inventors: Kundan Singh, Singapore (SG); Cherng Linn Teo, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/634,971

(22) PCT Filed: Aug. 1, 2017

(86) PCT No.: PCT/US2017/044775
§ 371 (c)(1),
(2) Date: Jan. 29, 2020

(87) PCT Pub. No.: WO2019/027438
PCT Pub. Date: Feb. 7, 2019

(65) Prior Publication Data

US 2020/0238723 A1 Jul. 30, 2020

(51) Int. Cl.
*B41J 2/175* (2006.01)
*F04B 43/06* (2006.01)
(Continued)

(52) U.S. Cl.
CPC ..... *B41J 2/17596* (2013.01); *F04B 43/06* (2013.01); *B41J 2/1752* (2013.01);
(Continued)

(58) Field of Classification Search
CPC .. B41J 2/17596; B41J 2/1752; B41J 2/17566; B41J 2002/14362; B41J 2/175; F04B 43/06; F04B 13/00
See application file for complete search history.

(56) References Cited

U.S. PATENT DOCUMENTS 4,263,602 A 4/1981 Matsumoto et al.
4,542,766 A 9/1985 Gawer et al.
(Continued)

FOREIGN PATENT DOCUMENTS

GB 871345 6/1961
JP 201007912 9/1996
RU 129183 U1 6/2013

OTHER PUBLICATIONS

Wang, X-Q. et al., A Normally Closed in-channei Micro Chock Valve, Jan. 27, 2000, < http://ieeexplore.ieee.org/document/838492/ > 1 page.

*Primary Examiner* — Bradley W Thies
(74) *Attorney, Agent, or Firm* — HP Inc. Patent Department

(57) ABSTRACT

Examples of vacuum operated pumps are described herein. In an example, a vacuum operated pump includes a plurality of fluid ports, such as an inlet port and an outlet port. The vacuum operated pump may also include a communication port and a diaphragm. The communication port may provide for fluid communication among the plurality of fluid ports. The diaphragm may control the plurality of the fluid ports and the communication port. The diaphragm may mate with the communication port in an idle state of the vacuum operated pump to isolate each of the plurality of fluid ports.

17 Claims, 7 Drawing Sheets

(51) Int. Cl.
*B41J 2/14* (2006.01)
*F04B 13/00* (2006.01)

(52) U.S. Cl.
CPC .. *B41J 2/17566* (2013.01); *B41J 2002/14362* (2013.01); *F04B 13/00* (2013.01)

(56) References Cited

U.S. PATENT DOCUMENTS

| | | | | |
|---|---|---|---|---|
| 4,558,995 | A | 12/1985 | Furukawa | |
| 5,542,918 | A * | 8/1996 | Atkinson | A61M 1/0064 417/401 |
| 5,554,011 | A | 9/1996 | Bales et al. | |
| 5,902,096 | A * | 5/1999 | Behringer | F04B 43/06 417/395 |
| 2008/0043076 | A1 | 2/2008 | Coffey et al. | |
| 2015/0125318 | A1 | 5/2015 | Tetzlaff et al. | |

* cited by examiner

VACUUM OPERATED PUMPS

BACKGROUND

Positive displacement pumps, such as vacuum operated pumps, have been used in a variety of applications, where fluid from a supply side may be provided to a receiving side. For instance, the positive displacement pumps may be used in printer systems for supplying ink to a print head assembly. Such pumps generally include an inlet port for ingress of fluid and an outlet port to discharge the fluid. To ensure that the vacuum operated pump is adequately operated and the ports work efficiently, for instance, to avoid accidental discharge from the outlet port, mechanisms to isolate the ports may be provided. For example, the inlet port and the outlet port may be isolated using additional valves, such as shut off valves. Further, such shut off valves in turn may be operated by an actuating mechanism to open and shut in accordance with the operations of the pump.

BRIEF DESCRIPTION OF FIGURES

The following detailed description references the drawings, wherein.

DETAILED DESCRIPTION

Figure 1:
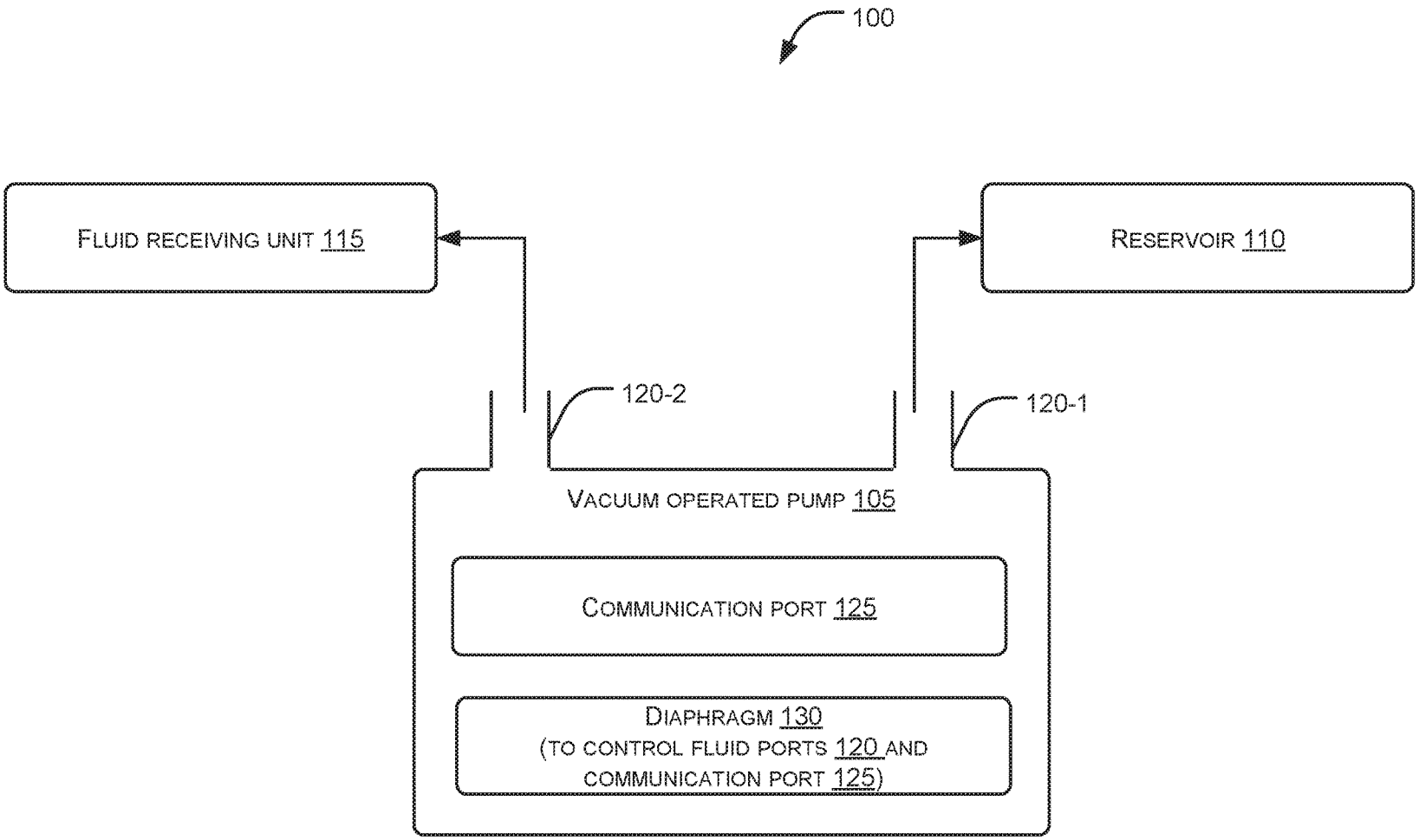
FIG. 1 illustrates an example block diagram representation of an apparatus implementing a vacuum operating pump, according to an example implementation of the present subject matter.

Pumps are generally used for moving fluids from a reservoir to a receiver. The pumps may be classified in various categories, based on principle of operation. Positive displacement pump is one such category of pumps, where fluid may be pumped with substantially the same speed regardless of pressure on an inlet end. One of commonly used positive displacement pumps are vacuum operated pumps. Generally, in vacuum operated pumps, partial vacuum is created to allow ingress and discharge of fluids. The vacuum operated pumps have been used in a variety of applications, where a fluid from a reservoir may be provided to a receiving side. Vacuum operated pumps may be used in printer systems, where ink from a reservoir may be provided to a print head assembly.

To prevent accidental discharge of fluid and to ensure that the vacuum operated pump operates properly the outlet port and an inlet port are often isolated using additional valves, such as shut off valves. For example, in a printer system with four color based color system, four shut off valves may be used to separate each intake port from the outlet port. Such shut off valves in turn may be operated by an actuating mechanism to open and shut in accordance with the operations of the pump. The actuating mechanism may in turn be integrated with a control unit to synchronize the functioning of the shut off valves with that of the pump. This in turn may make the pump assembly bulky, costly, resource intensive, and complex.

Various examples of a vacuum operated pump, and systems incorporating such vacuum pumps, are described. In an example, the vacuum operated pump may include a plurality of fluid ports, such as an inlet port and outlet port, to receive and discharge fluid. The vacuum operated pump may also include a communication port to control flow of fluid from the inlet port to the outlet port. In an open state, the communication port may allow flow of fluid from the inlet port towards the outlet; however, in a closed state, the communication port may block the flow of fluid to the outlet port, thereby isolating the two ports.

In one example, the fluid ports and the communication port may be controlled by a reciprocating motion of a diaphragm of the vacuum operated pump. For instance, in an idle state of the vacuum operated pump, i.e., when vacuum operated pump is not operating, the diaphragm may be in collapsed state to mate with communication port, thereby sealing the same. As a result of communication port being sealed, the fluid ports are automatically isolated to prevent flow of fluid from the inlet to outlet and subsequently to a fluid receiving unit, when the vacuum operated pump is idle.

During operation, on application of suction pressure, the diaphragm may expand to open the communication port and creating negative pressure in the vacuum operated pump. The negative pressure may in turn cause the inlet port to open to allow ingress of the fluid from a reservoir. As the fluid enters the pump, the negative pressure may be released through a vent, thus allowing diaphragm to move to back to original position, i.e., collapsed state. The upward motion of the diaphragm causes positive pressure to be developed again in the pump. Consequently, the outlet port may open to discharge the fluid from the pump. As the diaphragm returns to original position, i.e., collapsed state, the communication port may be sealed again, thereby separating and isolating the fluid ports.

Thus, the present subject matter provides a vacuum operated pump, where the reciprocating motion of the diaphragm not only controls the fluid ports for ingress and discharge of fluids but also the communication port, which in turn may provide for isolating fluid ports. As the fluid ports may now be efficiently isolated without additional valves, such as the shut off valves, the vacuum operated pump may also be free from other mechanisms associated with a shut off valve, such as an actuation mechanism for controlling the shut off valves. Consequently, the vacuum operated pump may also be free from an additional set-up used for integrating the actuation mechanism with a control unit to synchronize the functioning of the shut off valve with that of the pump. Moreover, as the communication port may block a fluid channel that may be between fluid ports, a separate shut off valve may not be installed for each inlet port.

Accordingly, with the communication port providing for isolation of the fluid ports and the diaphragm controlling both the fluid ports and the communication port, number of pump components may be substantially reduced, thereby making entire pump assembly cost effective and compact. Further, it will be appreciated that higher the number of components, higher the cost and the efforts in establishing the additional control mechanisms and therefore with fewer components, the vacuum operated pump of the present subject matter may be resource efficient.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

Figure 2:
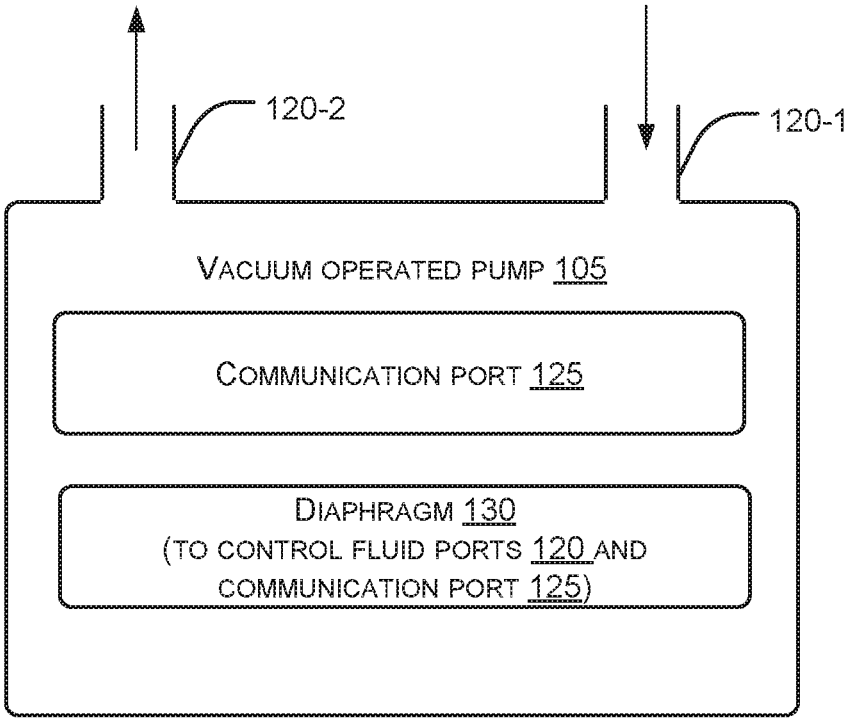
FIG. 2 illustrates an example block diagram representation of the vacuum operating pump, according to an example implementation of the present subject matter.

FIG. 1 illustrates a block diagram of an example apparatus 100 implementing a vacuum operated pump 105, and FIG. 2 illustrates a block diagram of the vacuum pump 105, according to an example implementation of the present subject matter. The apparatus 100 may be implemented a variety of systems, for instance a printer system, where ink may be provided from an ink source to a print head assembly via the vacuum operated pump 105.

In an example, the apparatus may include a reservoir 110, such as the ink source and a fluid receiving unit 115, such as the print head assembly. The fluid from the reservoir 110 may be provided to the fluid receiving unit 115 using the vacuum operated pump 105, hereinafter referred to as pump 105. The pump 105, amongst other things, may include a plurality of fluid ports 120, such as an inlet port 120-1 and an outlet port 120-2, a communication port 125 to provide for communication between the fluid ports 120, and a diaphragm 130 to control opening and closing of the fluid ports 120 and the communication port 125.

According to an aspect of the present subject matter, the communication port 125 is disposed in the vacuum operated pump 105 such that the fluid from the inlet port 120-1 may be provided to the outlet port 120-2 through the communication port 125. Thus, in an open state of the communication port 125, the fluid from the inlet port 120-1 may be allowed to flow to the outlet port 120-2, from where it may be discharged to the fluid receiving unit 115.

In an idle state of the pump 105, i.e., when pump 105 is not operating, the diaphragm 130 may be in a collapsed state to mate or seal the communication port 125, as explained in detail in subsequent figures. As a result of the communication port 125 being closed, the flow of the fluid to the outlet port 120-2 is restricted thereby isolating the outlet port 120-2 from the inlet port 120-1. During operation or in active state, the diaphragm 130 may expand to open the communication port 125. Further, as the communication port 125 open, the negative pressure may develop in the pump 105 causing the inlet port 120-1 to open to allow ingress of the fluid into a fluid chamber (illustrated in FIG. 6). The negative pressure may be released after a certain time, which allows the diaphragm 130 to return to a collapsed state. This develops positive pressure in the pump 105, thus opening the outlet port 120-2 for discharging the fluid. Thus, in the active state, the communication port 125 and a fluid port 120 may open and other(s) fluid ports 120 may close to provide for pumping of fluid. Details pertaining to the vacuum operated pump 105 in the idle state and in operation are discussed in detail in subsequent figures.

Figure 3:
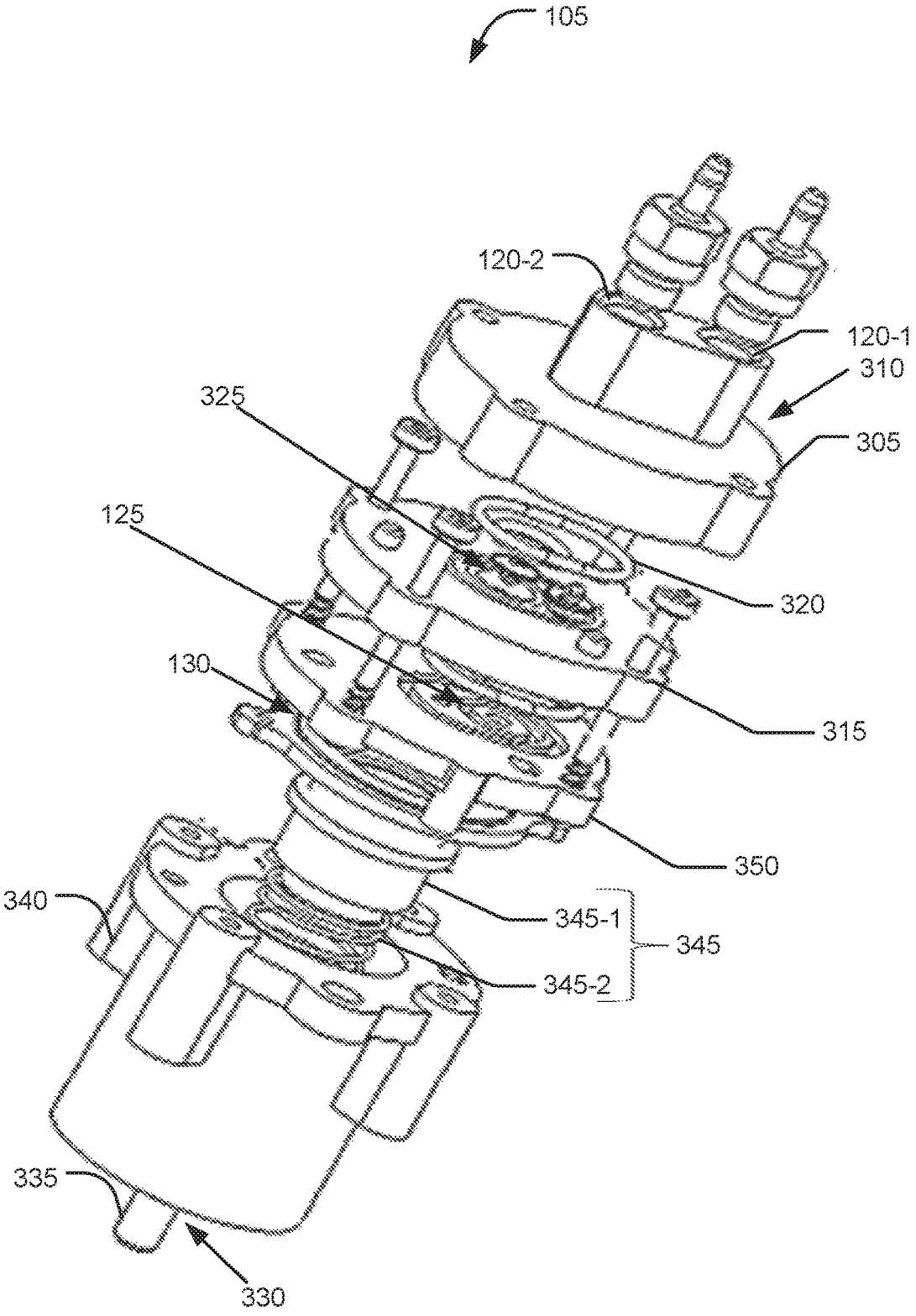
FIG. 3 illustrates an isometric view of the vacuum operated pump, according to an example implementation of the present subject matter.
Figure 4:
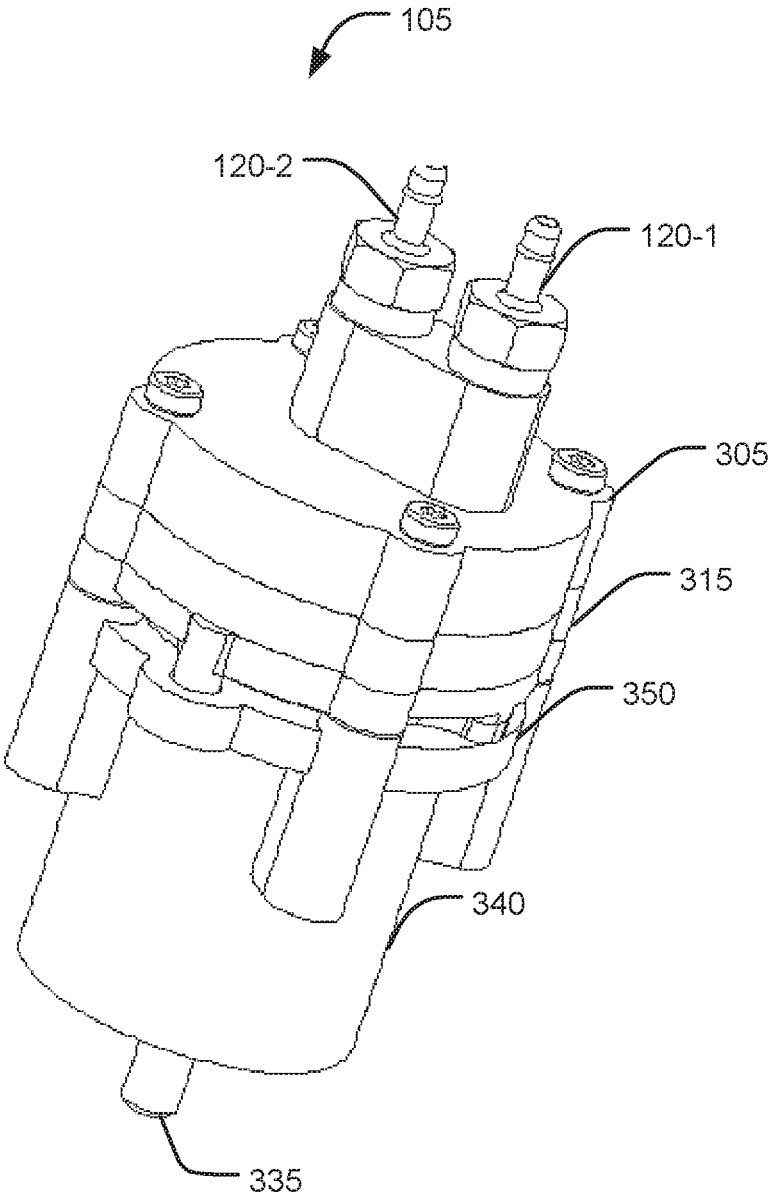
FIG. 4 illustrates an exploded view of the vacuum operated pump, according to an example implementation of the present subject matter.

FIG. 3 illustrates an exploded view of the pump 105 and FIG. 4 illustrates an isometric view of the pump 105, according to example implementations of the present subject matter. For the sake of brevity, two fluid ports, the inlet fluid port 120-1 and the outlet fluid port 120-2 are illustrated; however, it will be appreciated that the pump 105 may include more than two fluid ports as well. The inlet port 120-1 and the outlet port 120-2 may be provided in a fluid injection housing 305 disposed at a first end 310 of the pump 105. The inlet port 120-1 may be coupled to the reservoir 110 and the outlet port 120-2 may be coupled to the fluid receiving unit 115.

The fluid injection housing 305 may be coupled to a valve housing 315. The fluid injection housing 305 may be coupled via an O-ring 320 to the valve housing 315. The valve housing 315 may include a fluid valve 325 corresponding to each of the fluid ports 120. The fluid valve 325 may be a one-way valve to allow fluid to flow at a predetermined pressure in one direction and prevent back flow in an opposite direction. The fluid valve 325 may be, for instance, an umbrella valve, which may include an elastomeric component, such as a diaphragm to open or close the fluid valve 325 (and thus the fluid ports 120), based on a pressure inside the pump 105. In an example, the predetermined pressure in the pump 105 to control the fluid ports 120 and the fluid valves 325 is controlled by a reciprocating movement of diaphragm 130, as will be discussed in detail with reference to description of FIGS. 5-7.

Referring to the second end 330 of the pump 105, a vacuum port 335 may be provided at the second end 330 of the pump 130. In an example, while one end of the vacuum port 335 may be coupled to a vacuum pump (not shown in figures) to provide suction pressure, the other end, for instance, integrated with a diaphragm housing 340. The diaphragm housing 340 may include a cavity to house the diaphragm 130 and a biasing component 345, which may be coupled to the diaphragm 130. The biasing component 345 may be, for instance, a compressible spring 345-1 coupled to the diaphragm 130 through a spring mount 345-2. The biasing component 345 is disposed such that the biasing component 345 pushes the diaphragm 130 against the communication port 125, during an idle state of the pump 105. Thus, in the idle state, the fluid ports 120 may be isolated from each other. On the other hand, in an active state of the pump 105, i.e., when suction pressure is applied at the vacuum port 335, the diaphragm 130 may be pulled, thereby compressing the bias component 325. As a result of the diaphragm 130 being pulled, the communication port 125 may open, which may provide for opening of the inlet port 120-1.

In an example, the communication port 125 may be a port formed in a port plate 350, which may dome shaped, i.e., in the form of a hemi-sphere so that the diaphragm 130 may easily cooperate with the port plate 350 to seal the communication port 125 in the idle state of the pump 105. Further, in the active state, the diaphragm 130 may expand to provide for creation of the fluid chamber with a valve 325, associated with the inlet port 120-1, for holding the fluid entering the pump 105 through the inlet port 120-1.

Figure 5:
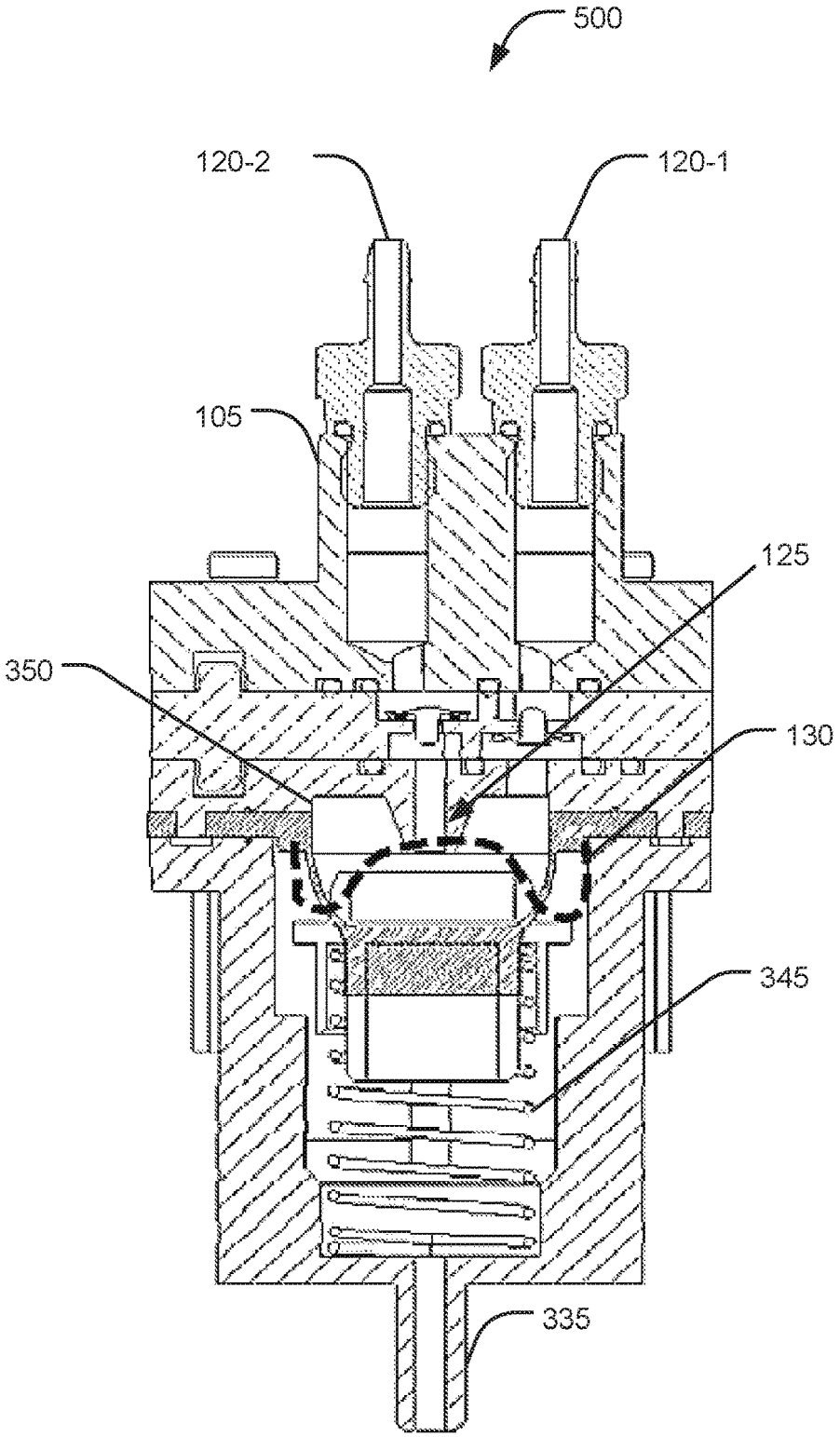
FIG. 5-7 illustrate cross-sectional views of the vacuum operated pump in various states, according to example implementations of the present subject matter.
Figure 6:
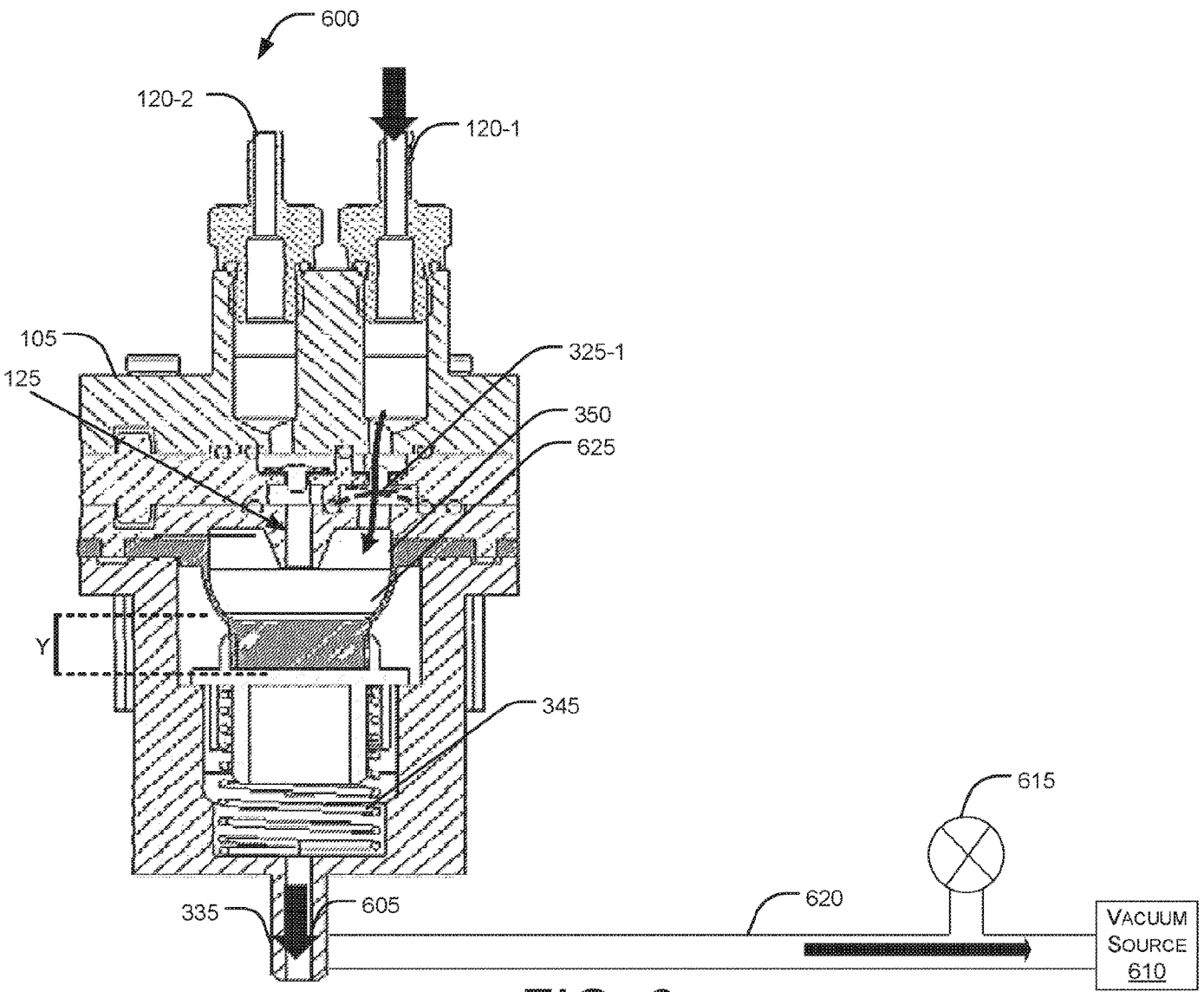
Figure 7:
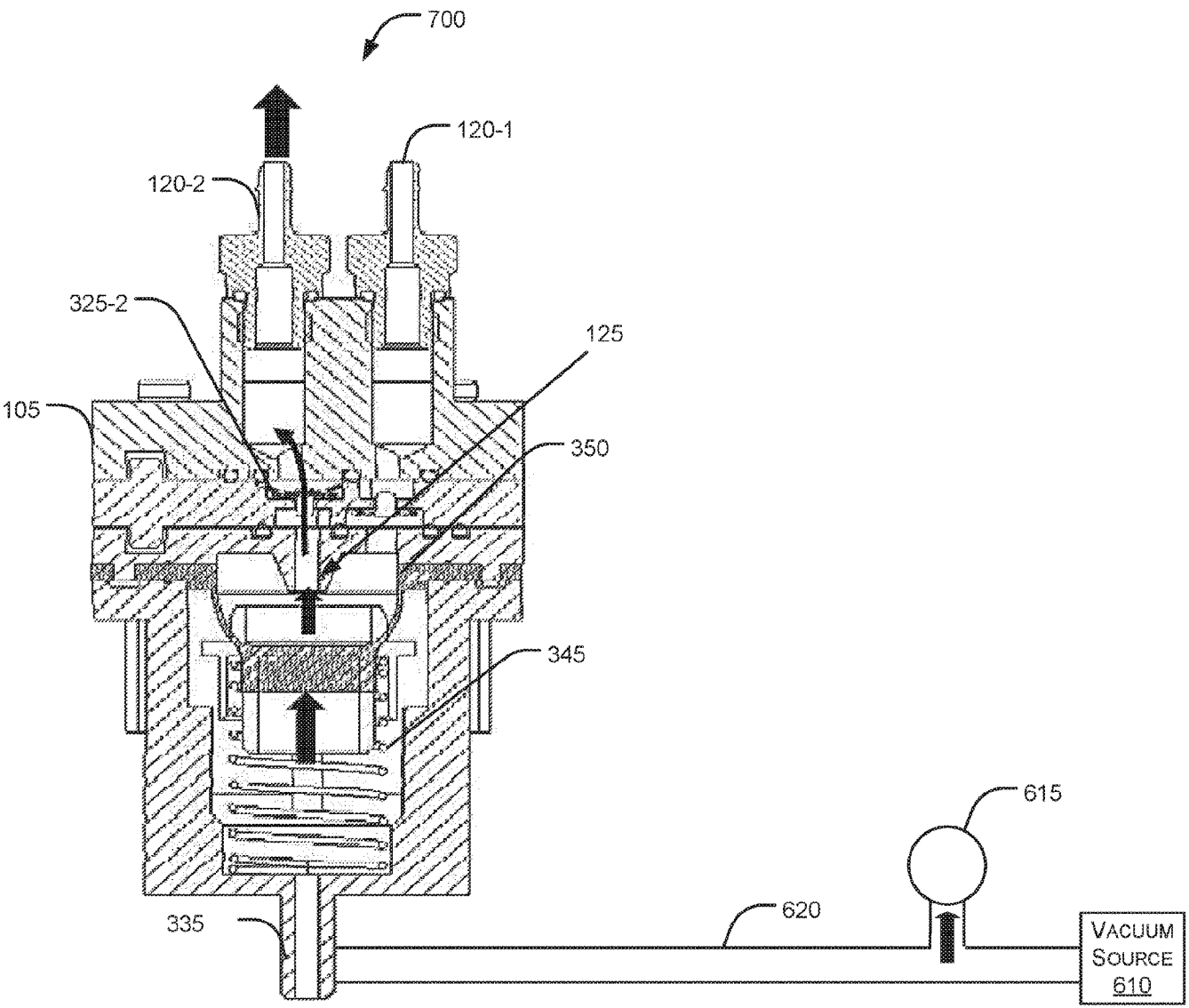

FIG. 5-7 illustrate the pump 105 in various positions, according to example implementations of the present subject matter. Although the operations of the pump 105 has been explained in considerable details with respect to a single inlet port and a single outlet port; it will be appreciated the principles recited herein extend to embodiments, where the pump 105 may include multiple inlet ports and multiple outlet ports.

Referring to FIG. 5, the pump 105 is illustrated in an idle state 500, where the pump 105 is not operating. As mentioned earlier, the idle state 500 may refer to a state, when the fluid is not to be supplied to the fluid receiving unit 115, and hence, the pump 105 may not be operated. Typically, in an idle state, to avoid accidental discharge of fluid, fluid ports, such as the fluid ports 120 may be separated by a shut off valve and an associated mechanism to control the opening and closing of the shut off valve with respect to the idle state or an active state of the pump 105. According to an aspect of the present subject matter, the fluid ports 120 may be separated by the communication port 125, which may control flow of fluid to the outlet port 120-2.

In an example, in the idle state 500, as the pump 105, is not to be operated, no suction pressure may be applied to the vacuum port 335. In this state, the biasing component 345 may push the diaphragm 130 (represented by broken lines) with a force acting upwards, i.e., towards the communication port 125. As a result, the diaphragm 130 mates with the port plate 350 having the communication port 125, thereby sealing the communication port 125. The sealing of the communication port 125 may prevent flow of the fluid from the inlet port 120-1 to the outlet port 120-2, thereby isolating the two fluid ports 120. The isolation in turn prevents the pump 105 from leaking the fluid or pressure, thereby maintaining a requisite backpressure at the fluid receiving unit 115. Thus, the diaphragm 130 and the communication port 130 may efficiently isolate the fluid ports 120 in the idle state 500 of the pump 105.

FIG. 6 illustrates the pump 105 in an inlet active state 600, according to example implementation of the present subject matter. The inlet active state 600 of the pump 105 may refer to a state of the pump 105, where the pump 105 may be operated to open the inlet port 120-1 to allow the fluid to enter the pump 105. In an example, to operate the pump 105, a suction pressure in form of a vacuum pull (indicated by arrow 605) may be applied at the vacuum port 335. For instance, the vacuum port 335 may be coupled to a vacuum source 610, which may be operated to provide the suction pressure at the vacuum port 335. Further, a vent valve 615 may be closed to maintain negative pressure in the pump 105. The vent valve 615 may be provided in a pressure line 620 coupled to the vacuum port 335. The vacuum source 610 and the vent valve 615 may be controlled by a control unit, such as, an electronic control unit of an apparatus, such as a printer system.

The suction pressure may pull the diaphragm 130 downwards, i.e., away from the communication port 125, thereby causing the diaphragm to expand. As a result, the diaphragm may be displaced by a distance denoted by "Y" in FIG. 6. The displacement of the diaphragm 130 open the communication port 125 and creates a suction pressure (negative pressure) to open the inlet valve 325-1 corresponding to the inlet port 120-1. In an example, the inlet valve 325-1 may be a one-way valve, such as an umbrella valve adapted to open when the negative pressure is created in the pump 105. The umbrella valve may allow inflow of the fluid once the negative pressure is enough to lift the convex diaphragm from its seat to allow flow at a predetermined pressure in one way. The opening of the inlet port 120-1 and the inlet valve 325-1 allow the fluid to enter a fluid chamber 625, which may now be created owing to displacement of the diaphragm 130.

As the diaphragm 130 displaces, i.e., expands, the communication port 125 may open, and the inlet valve 325-1 together with the diaphragm 130 in the expanded form may form the fluid chamber 625. The fluid from the inlet port 120-1 may be collected in the fluid chamber 625. The inlet valve 325-1 and thus, the inlet port 120-1 may close again, once pressure applied at the vacuum port 335 is stopped, as illustrated in FIG. 7.

FIG. 7 illustrates the pump 105 in an outlet active state 700 of the pump 105, according to example implementation of the present subject matter. The inlet active state 600 and the outlet active state 700 may be collectively referred to as an active state of the pump 105. In the outlet active state 700, pressure may no longer be applied to the vacuum port 335, and vacuum creating the suction pressure is allowed to dissipate. For instance, in the outlet active state 700, the pressure may be released through the vent valve 615, which may open into the atmosphere. This allows the biasing component 345 to return to its original position as illustrated in FIG. 5, when the pump 105 is in the idle state 500. Thus, the diaphragm 130 may be displaced by the distance "Y" in an upward direction, i.e., towards the communication port 125.

The upward motion of the diaphragm 130 causes positive pressure to be developed, thereby opening the outlet valve 325-2 and the outlet port 120-2 to allow the fluid in the fluid chamber 625 to discharge through the outlet port 120-2. Thus, the upward motion of the diaphragm 130 may cause the fluid to be discharged.

Repeated cycles of the inlet active state 600 as illustrated in FIG. 5 and the outlet active state 700 as illustrated in FIG. 7 to allow pumping of fluid at a given flow rate. Further, the frequency of cycles may also be adjusted to match the flow rate. This way a reciprocating motion of the diaphragm 130 may allow fluid to be pumped from the reservoir 110 to the fluid receiving unit 115.

Further, the reciprocating motion of the diaphragm may not only control the fluid ports 120 but also the communication port 125. As the communication port 125 is controlled by the diaphragm 130, a separate mechanism for controlling the pump 105 and a separate mechanism for controlling the fluid ports 120 may not be required. Also, as described above, the communication port 125 along with the diaphragm 130 may efficiently isolate multiple fluid ports from each other to prevent accidental discharge of fluid or pressure. As a result, the pump 105 may be made compact and economical owing to lesser number of components and resources required to work the pump 105.

In an example, upon discharging requisite amount of the fluid, the pump 105 may no longer be operated. Accordingly, the various components of the pump 105 may move to a position corresponding to the idle state 500 of the pump 105, as illustrated in FIG. 5. For instance, the diaphragm 130 may be in a collapsed state sealing the communication port 125, and the fluid port 120 may also be closed, thereby preventing inflow and outflow of the fluid.

In an example implementation of the present subject matter, the pump 105 may be implemented in a printer system, and operations of the pump 105 may be controlled by a control unit of the printer system. For instance, when ink (fluid) is to be supplied to a print head assembly, the control unit may provide a trigger to activate another pump to generate a vacuum pull at the vacuum port 335 to operate the pump 105. As a result of vacuum pull being generated, the inlet port 120-1 may open to allow ingress of ink in a fluid chamber formed between the inlet valve 325-1 and the diaphragm 130, which in an expanded state. The vacuum generation pump may be repeatedly operated to cause the diaphragm 130 to move in the pump 105, thereby opening and closing the fluid ports 120 to transport the ink from an ink reservoir to the print head assembly, as described with reference to description of FIG. 6 and FIG. 7.

Further, when no ink is to be supplied, the suction pressure may no longer be applied at the vacuum port 335, and the pump 105 may move to its idle state, as depicted in FIG. 5. In the idle state, the fluid ports 120 may be suitably isolated by the diaphragm 130 and the communication port 125 to prevent discharge of ink to the print head assembly. This may also help in maintaining pressure at the print head assembly side. Owing to efficient isolation, wastage of ink may be prevented. Further, due to diaphragm 130 performing dual function of pumping the ink as well isolating the fluid ports, lesser number of components may now be involved, thus making the pump cost efficient and resource efficient.

Although examples for vacuum operated devices have been described in language specific to structural features and/or methods, it is to be understood that the appended claims are not limited to the specific features or methods described. Rather, the specific features and methods are disclosed as examples for the vacuum operated pumps.

We claim:

1. A vacuum operated pump comprising:

a plurality of fluid ports to receive and discharge fluid;

a communication port to provide fluid communication among the plurality of fluid ports; and a diaphragm to control the plurality of the fluid ports and the communication port, wherein the diaphragm is spring-biased to close the communication port in an idle state of the vacuum operated pump to isolate each of the plurality of fluid ports, and wherein, on application of vacuum pressure, the diaphragm is to expand to open the communication port and open one of the fluid ports to allow ingress of fluid therethrough and, on release of the vacuum pressure, the diaphragm is to collapse to discharge the fluid through another of the fluid ports and is spring-biased to close the communication port.

2. The vacuum operated pump as claimed in claim 1, wherein the plurality of fluid ports comprises umbrella valves.

3. The vacuum operated pump as claimed in claim 1, wherein the vacuum operated pump further comprises a vacuum port to receive vacuum pressure to operate the diaphragm.

4. The vacuum operated pump as claimed in claim 1, wherein the diaphragm is spring-biased by a compression spring to close the communication port and maintain the diaphragm in a collapsed state in the idle state of the vacuum operated pump.

5. The vacuum operated pump as claimed in claim 1, wherein the vacuum operated pump further comprises a port plate, the communication port being formed in the port plate, and wherein the port plate is disposed between the plurality of fluid ports and the diaphragm.

6. The vacuum operated pump as claimed in claim 1, wherein in an active state of the vacuum operated pump, the diaphragm is to expand to form a fluid chamber with a valve of the one of the fluid ports to hold the fluid entering therethrough.

7. A vacuum operated pump comprising:

a plurality of fluid ports, the plurality of ports comprising an inlet port and an outlet port;

a communication port to control fluid communication between the inlet port and the outlet port; and a diaphragm, wherein the diaphragm is spring-biased and, with applied suction pressure, is to expand to open the communication port and open the inlet port to allow ingress of fluid therethrough and, with release of the suction pressure, is to collapse to discharge the fluid through the outlet port and is spring-biased to close the communication port, wherein the communication port is disposed between the diaphragm and the plurality of fluid ports.

8. The vacuum operated pump as claimed in claim 7, wherein the vacuum operated pump further comprises a port plate, the communication port being formed in the port plate.

9. The vacuum operated pump as claimed in claim 8, wherein, in an idle state of the vacuum operated pump, the diaphragm is to collapse to mate with the port plate to seal the communication port to isolate the inlet port and the outlet port.

10. The vacuum operated pump as claimed in claim 7, wherein the vacuum operated pump further comprises a vacuum port to be coupled to a vacuum source providing the suction pressure.

11. The vacuum operated pump as claimed in claim 7, wherein the diaphragm is spring-biased by a compression spring to close the communication port.

12. An apparatus comprising:

a reservoir;

a fluid receiving unit to receive the fluid;

a vacuum operated pump to provide the fluid from the reservoir to the fluid receiving unit, the vacuum operated pump comprising, a plurality of fluid ports provided at a first end of the vacuum operated pump to receive and discharge the fluid;

a communication port to provide fluid communication among the plurality of fluid ports; and a diaphragm operable to control opening and closing of the communication port, wherein the diaphragm is spring-biased to collapse to seal the communication port in an idle state of the vacuum operated pump to prevent fluid communication between the plurality of fluid ports, and wherein, with application of vacuum pressure, the diaphragm is to expand to open the communication port and open one of the fluid ports to allow ingress of fluid therethrough and, with release of the vacuum pressure, the diaphragm is to collapse to discharge the fluid through another of the fluid ports and is spring-biased to seal the communication port.

13. The apparatus as claimed in claim 12, wherein the apparatus comprises a vacuum source coupled to the vacuum operated pump to operate the diaphragm of the vacuum operated pump.

14. The apparatus as claimed in claim 13, wherein the vacuum operated pump comprises a vacuum port provided at a second end of the vacuum operated pump, the vacuum port to be coupled to the vacuum source.

15. The apparatus as claimed in claim 12, wherein the vacuum operated pump comprises a port plate disposed between the plurality of fluid ports and the diaphragm, the communication port being formed in the port plate, and wherein the diaphragm is to mate with the port plate to seal the communication port.

16. The apparatus as claimed in claim 12, wherein, in an active state of the vacuum operated pump, the diaphragm is to expand to open the communication port and the another of the fluid ports.

17. The apparatus as claimed in claim 12, wherein the diaphragm is spring-biased by a compression spring to seal the communication port.

* * * * *